US006857969B2

(12) United States Patent
Rice

(10) Patent No.: US 6,857,969 B2
(45) **Date of Patent: *Feb. 22, 2005**

(54) METAL WOOD

(75) Inventor: Scott A. Rice, Solana Beach, CA (US)

(73) Assignee: Acushnet Company, Fairhaven, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/683,005

(22) Filed: Oct. 10, 2003

(65) Prior Publication Data

US 2004/0077432 A1 Apr. 22, 2004

Related U.S. Application Data

(62) Division of application No. 10/164,434, filed on Jun. 6, 2002, now Pat. No. 6,669,576.

(51) Int. Cl.[7] ..... A63B 53/02

(52) U.S. Cl. ..... 473/244; 473/246; 473/248; 473/314; 473/345; 473/305

(58) Field of Search ..... 473/244–248, 473/288, 305–315, 345

(56) References Cited

U.S. PATENT DOCUMENTS

| | | | | | |
|---|---|---|---|---|---|
| 2,067,556 | A | * | 1/1937 | Wettlaufer | 473/308 |
| 2,219,670 | A | * | 10/1940 | Wettlaufer | 473/247 |
| 4,438,931 | A | * | 3/1984 | Motomiya | 473/346 |
| 4,854,582 | A | * | 8/1989 | Yamada | 473/309 |
| 4,948,132 | A | * | 8/1990 | Wharton | 473/246 |
| 5,207,428 | A | * | 5/1993 | Aizawa | 473/311 |
| 5,232,224 | A | * | 8/1993 | Zeider | 473/345 |
| 5,346,217 | A | | 9/1994 | Tsuchiya et al. | |
| 5,429,357 | A | * | 7/1995 | Kobayashi | 473/311 |
| 5,460,371 | A | | 10/1995 | Takeda | |
| 5,464,216 | A | | 11/1995 | Hoshi et al. | |
| 5,485,998 | A | | 1/1996 | Kobayashi | |
| 5,509,660 | A | | 4/1996 | Elmer | |
| 5,538,246 | A | * | 7/1996 | Dekura | 473/311 |
| 5,575,723 | A | * | 11/1996 | Take et al. | 473/305 |
| 5,704,850 | A | | 1/1998 | Shieh | |
| 5,776,011 | A | | 7/1998 | Su et al. | |
| 5,797,806 | A | * | 8/1998 | Butler | 473/310 |
| 5,839,973 | A | * | 11/1998 | Jackson | 473/305 |
| 5,906,549 | A | * | 5/1999 | Kubica | 473/314 |
| 5,961,394 | A | * | 10/1999 | Minabe | 473/305 |
| 5,967,904 | A | | 10/1999 | Nagai et al. | |
| 6,001,027 | A | | 12/1999 | Hansberger | |
| 6,071,200 | A | | 6/2000 | Song | |
| 6,077,172 | A | * | 6/2000 | Butler | 473/305 |
| D437,375 | S | | 2/2001 | Hocknell et al. | |
| 6,238,300 | B1 | | 5/2001 | Igarashi | |
| 6,334,817 | B1 | | 1/2002 | Ezawa et al. | |
| 6,368,230 | B1 | * | 4/2002 | Helmstetter et al. | 473/244 |
| 6,575,843 | B2 | * | 6/2003 | McCabe | 473/245 |
| 6,634,958 | B1 | * | 10/2003 | Kusumoto | 473/310 |
| 6,669,573 | B2 | * | 12/2003 | Wood et al. | 473/246 |
| 2002/0052247 | A1 | | 5/2002 | Helmstetter et al. | |
| 2002/0065147 | A1 | | 5/2002 | Sano | |

FOREIGN PATENT DOCUMENTS

| | | | | |
|---|---|---|---|---|
| GB | 2225725 | * | 6/1990 | 273/167 H |
| GB | 2230459 | * | 10/1990 | 273/167 H |

* cited by examiner

*Primary Examiner*—Sebastiano Passaniti
(74) *Attorney, Agent, or Firm*—D. Michael Burns

(57) ABSTRACT

A golf club head having a stamped metal cup-shaped front section welded to a cast body, and a split hosel comprising upper and lower hosel elements, both integrally cast within the body of the club head for reduction of weight in the hosel area. The lower hosel element including varying boss members for receiving the bottom of a shaft. Each individual boss member having a shaft opening corresponding to a predetermined club lie and club face angle.

3 Claims, 8 Drawing Sheets

METAL WOOD

This application is a divisional of U.S. application Ser. No. 10/164,434, which was filed Jun. 6, 2002, now U.S. Pat. No. 6,669,576, and is incorporated herein in its entirety by express reference thereto.

FIELD OF THE INVENTION

The present invention relates generally to a metallic hollow golf club head, and specifically to an improved split hosel design.

BACKGROUND OF THE INVENTION

Golf club "metal woods", were originally manufactured primarily by casting of durable metals such as stainless steel, aluminum, beryllium copper, etc. into a unitary structure comprising of a metal body, face and hosel. As technology progressed it became more desirable to strengthen the face of the club, and usually this was achieved by using titanium material.

With a high percentage of amateur golfers constantly searching for more distance on their drives, the golf industry has responded by providing golf clubs specifically designed with distance in mind. The head sizes have increased which allows for the club to possess a higher moment of inertia, which translates to a greater ability to resist twisting on off-center hits. However, as a wood head becomes larger, its center of gravity will be moved back away from the face resulting in hits flying higher than expected. Reducing the lofts of larger head clubs is one way to compensate for this. Also with the larger heads, the center of gravity is moved further away from the axis that is created by the intersection of the hosel with the sole plate. This can cause these large head clubs to remain open on contact, thereby inducing a "slice" effect (in the case of a right-handed golfer, the ball deviates to the right). Offsetting the head and incorporating a hook face angle can help compensate for this by "squaring" the face at impact, but often more is required to eliminate the "slice" tendency.

The technological breakthrough in recent years towards providing the average golfer with more distance by making club heads larger, has been to keep the weight constant or even lighter, by casting consistently thinner shell thickness and going to lighter materials such as titanium. Also the face of the clubs have been steadily becoming extremely thin. The thinner face will maximize what is known as the Coefficient of Restitution (COR), which means that the more the face rebounds upon impact, the more energy that may be imparted to the ball, thereby increasing distance. In order to make the faces thinner, manufacturers have moved to forged or stamped metal faces which are stronger, in most cases, than those that are cast. Common practice is to integrate the forged or stamped metal face by welding it to the body at the sole and crown transitions. These transitions are the points on the club head that absorb the greatest amount of stresses as the club strikes the ball. Therefore, it is very desirable to provide a method for attaching the impact face portion to the body of the club head without sacrificing any COR (Coefficient of Restitution) value in the club.

SUMMARY OF THE INVENTION

In accordance with one aspect of the invention, a metal wood golf club head is provided which includes a hollow body having a stamped metal cup-shaped, front section welded to it. The body is preferably cast as a single member and includes a sole portion, a crown portion, a toe portion that extends into the impact face of the front section, a heel portion, a skirt portion, and split hosel elements, upper and lower, all of which define a cavity therein. The cup-shaped, front section forms a substantial portion of the impact face of the club, and has a wing element extending around and beyond the upper hosel element and into the body at the heel/skirt area of the club. In addition to the face and wing element, the front section comprises an upper lateral extension that engages the crown portion and a lower lateral extension that engages the sole portion.

In the invention, the hosel elements are preferably cast as an integral part of the body. This allows weight that is normally needed to support the hosel, to be used elsewhere for optimum ball flight.

The present invention further provides for a section of the impact face to be cast as part of the toe portion of the body, thereby removing welding procedures from this area and improving the ease of polishing and buffing of the toe. Providing the toe portion of the impact face to be cast with the body increases stability of the cast body during manufacturing and insures minimum deformation of the aesthetically critical toe area.

Since a stamped plate made of beta-titanium generally exhibits better strength and ductility properties than cast titanium, it is preferable to use it as a substantial portion of the impact face of the front section. It is preferred that in the joining of the front section to the body, the welding be removed from the crown/face and sole/face transition seams, which are points of critical stress. The present invention provides for these welds to be done a distance away from the transition seams, thereby keeping the thickness at the transitions much thinner than if welds were present. This increases the structural integrity of the club head and also achieves maximum allowable COR values.

The present invention also provides for a split hosel design. Upper and lower tubular hosel elements are preferably manufactured as part of the cast body. These elements are preferably a reduction in weight from a full hosel that extends from the crown to the sole. The upper hosel element preferably extends from the crown of the club head and the lower hosel element is preferably integral with the inner surface of the sole plate. The lower hosel element utilizes one of a plurality of boss members, each with a particular shaft opening location to effect a predetermined lie position. By positioning the shaft within the boss member in this manner, the lie of the golf club may be set at a pre-selected angle without any change to the master casting. To aid in the accommodation of different shaft angles, the upper hosel element is bendable to a slight extent.

The selection of club face angles from closed-face to open-faced can be achieved by the positioning of the boss member relative to the impact face, close to the face would create a more open-faced club angle, or conversely, away from the face, which would yield a more closed-face club angle.

The front section is preferably formed from a single stamped sheet metal plate, preferably of varied thickness, and being capable of being bent into a cup-shape. Each thickness area correlates to a thickness requirement of a corresponding part of the front section. The impact face, upper and lower lateral extensions, and wing element all having their own thickness requirements.

DETAILED DESCRIPTION OF THE PREFERRED EMBODIMENTS

Figure 1:
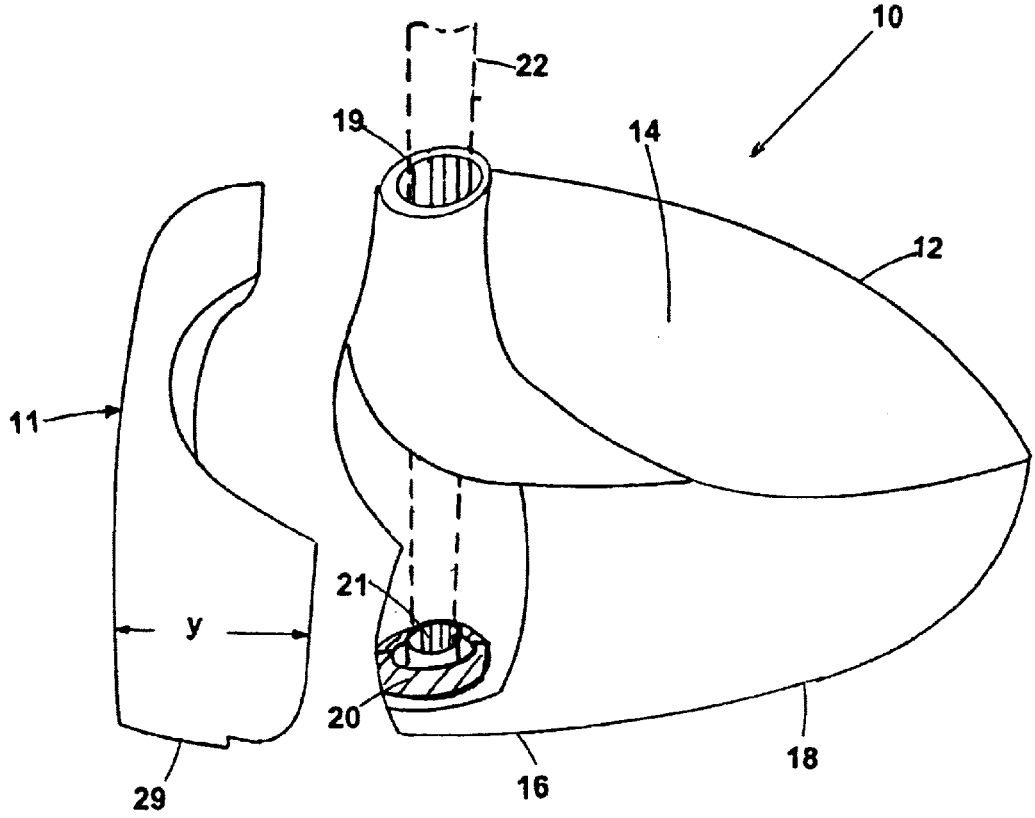
FIG. 1 is a side view illustrating the cup-like heel section and split hosel design.
Figure 2:
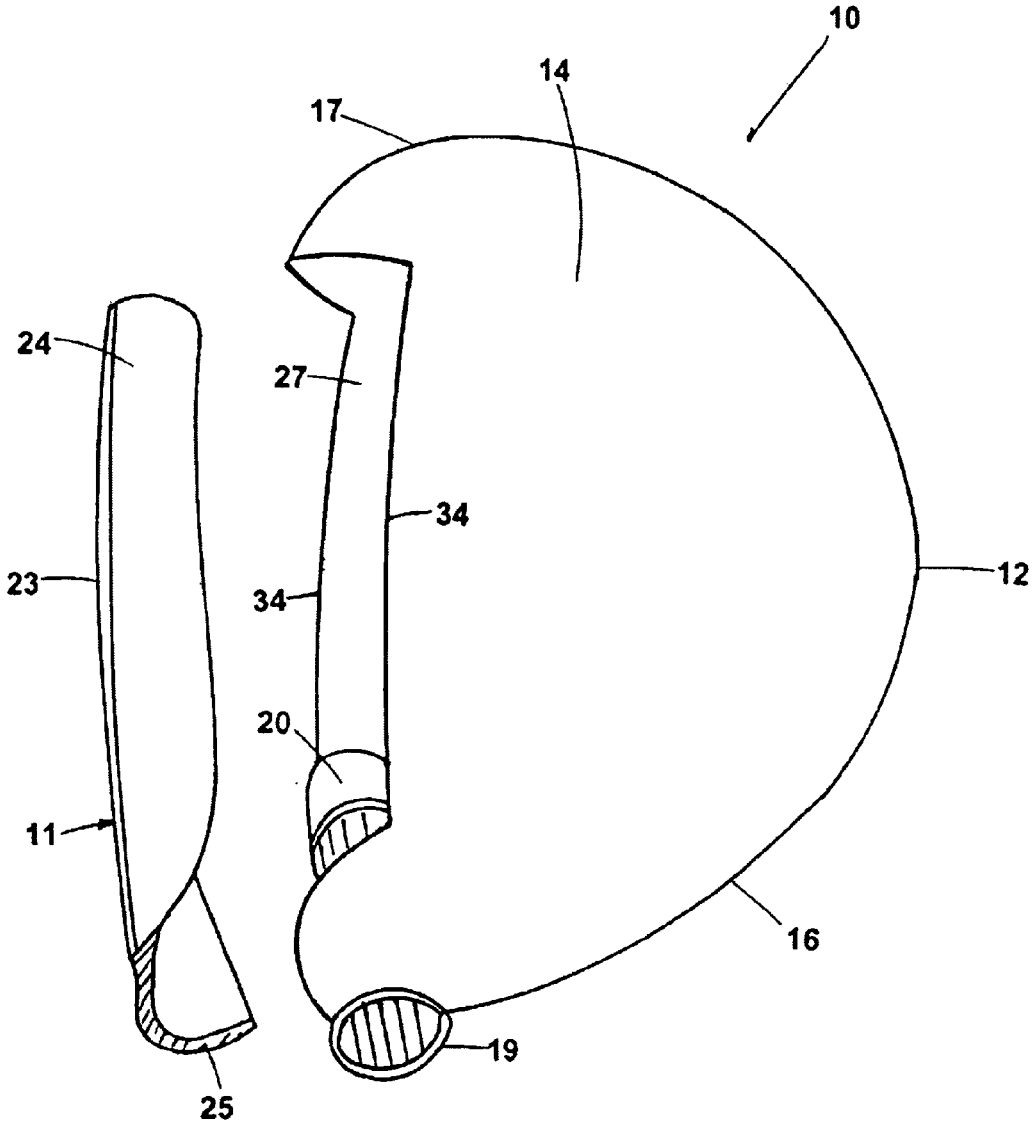
FIG. 2 is a top view of FIG. 1, lower and upper lateral extensions and cut out section of body.
Figure 3:
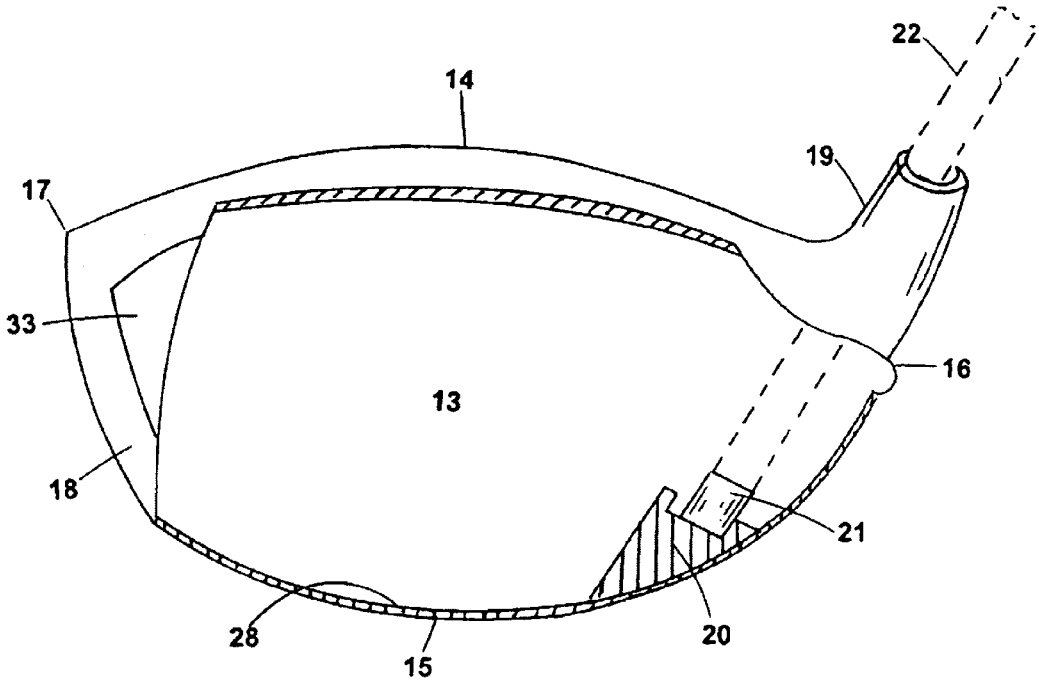
FIG. 3 is a front view depicting the cut out section and position of the boss member located on the inner sole surface.
Figure 4:
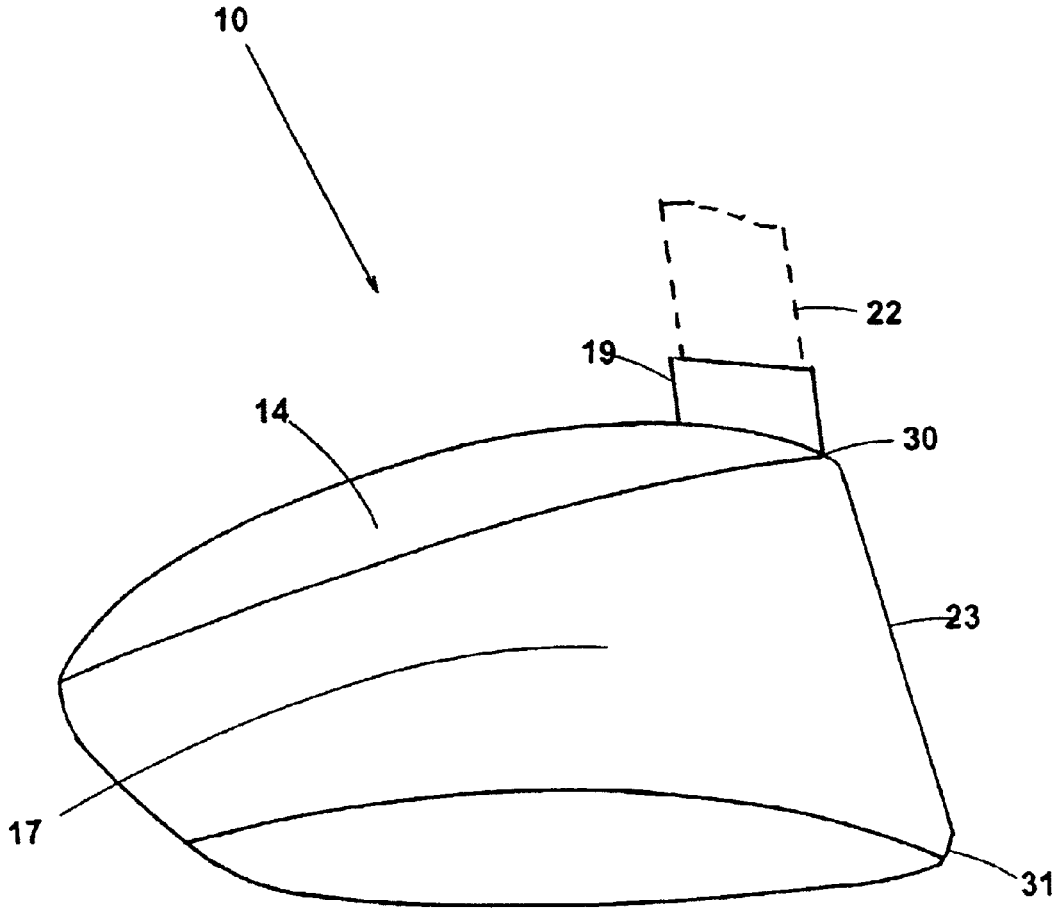
FIG. 4 is a toe view showing the transition positions.

Referring to the present invention, as shown in FIGS. 1–8, there is provided a golf club head 10, that is adapted for attachment to a golf club shaft 22, which for the sake of clarity, is shown in phantom. Club head 10 is integrally formed by coupling the edges of a cup-shaped, stamped metal front section 11 to a substantially hollow body 12 so as to form a cavity 13 therein. The preferred means for coupling is welding.

Figure 5A:
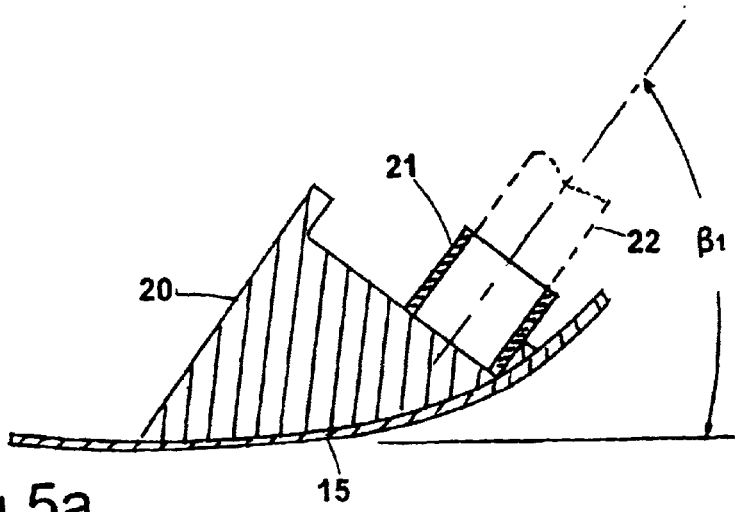
FIG. 5*a* is an elevational view of a boss member in a particular location within the lower hosel to provide a particular lie position.
Figure 5B:
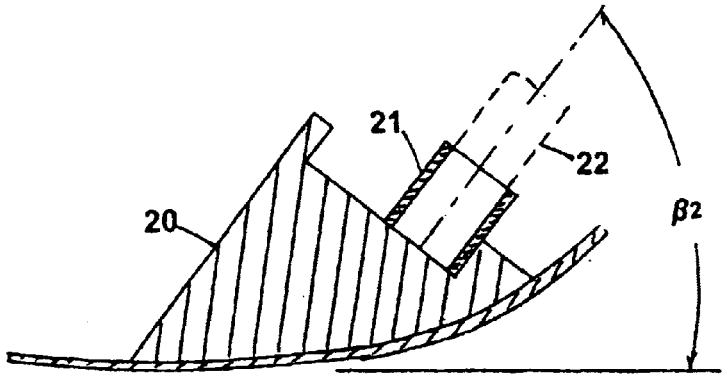
FIG. 5*b* is an elevational view with the boss member in a different location than FIG. 5*a*, wherein a steeper lie position is obtained.
Figure 5C:
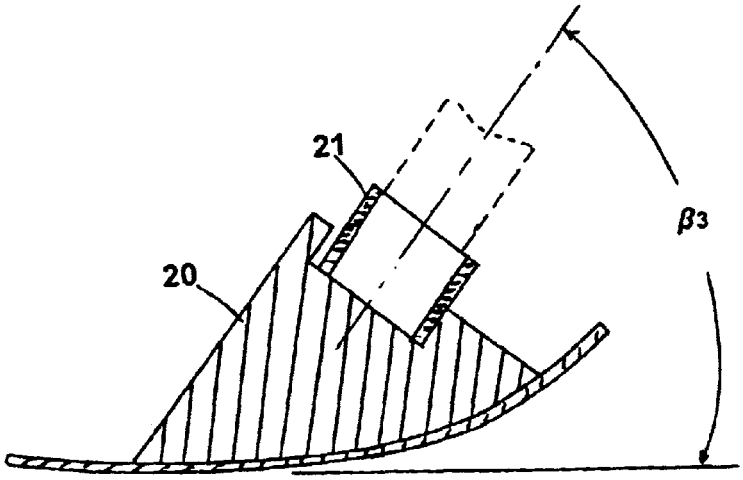
FIG. 5*c* is an elevational view with the boss member in another position to provide yet a steeper lie.

Body 12 is preferably cast of a titanium alloy. Body 12 includes a crown portion 14, a sole portion 15, a heel portion 16, a toe portion 17, having a front face section 33 forming part of an impact face 23 (to be described later), a skirt portion 18 connecting the heel portion 16 to the toe portion 17, a split tubular shaft support comprising of an upper hosel element 19 and a lower hosel element 20, and an opening 27 for receiving front section 11. Upper hosel element 19 preferably extends at least about 0.25 inch from the crown portion 14 and more preferably extends at least about 0.5 inch and is configured of a shape and size to receive golf club shaft 22 therein. Lower hosel element 20 preferably extends less than about 0.25 inch from the inside surface 28 of sole portion 15. In one embodiment a hollow boss member 21 is disposed in one of a plurality of lower hosel elements 20 and is of a size and shape to accommodate the tip end of the golf shaft 22. Shaft 22 can be placed within boss member 21, as shown in FIGS. 5*a*–5*c*, to selectively adjust to a predetermined club lie. FIG. 5*a* depicts shaft 22 at a relatively flat angle of lie with the angle β1 determined by the plane of the sole portion 15 and centerline of the shaft 22. The shaft 22 may be re-positioned at points providing steeper club lies, such as β2 and β3 in FIGS. 5*b* and 5*c* respectively. This provides the ability to pre-select a particular lie to fit an individual's swing can be met while using a universal master casting. The boss member 21 is welded at various locations within the lower hosel element 20 to selectively choose a particular lie. The procedure for varying the club lie is to slide the lower tip of shaft 22 through upper hosel element 19 and into boss member 21. While it is to be appreciated that the master casting does not need to be altered, upper hosel 19 is capable of being bent slightly to accommodate various shaft 22 angles. Also, the present invention would work with a conventional one-piece hosel design with some modifications to the shaft.

Figure 6A:
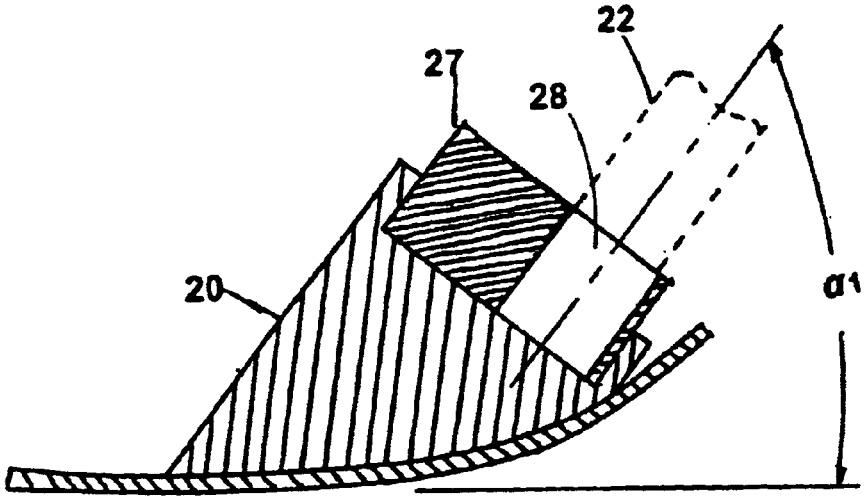
FIGS. 6*a* and 6*b* are elevational views wherein different boss members create the lie position.
Figure 6B:
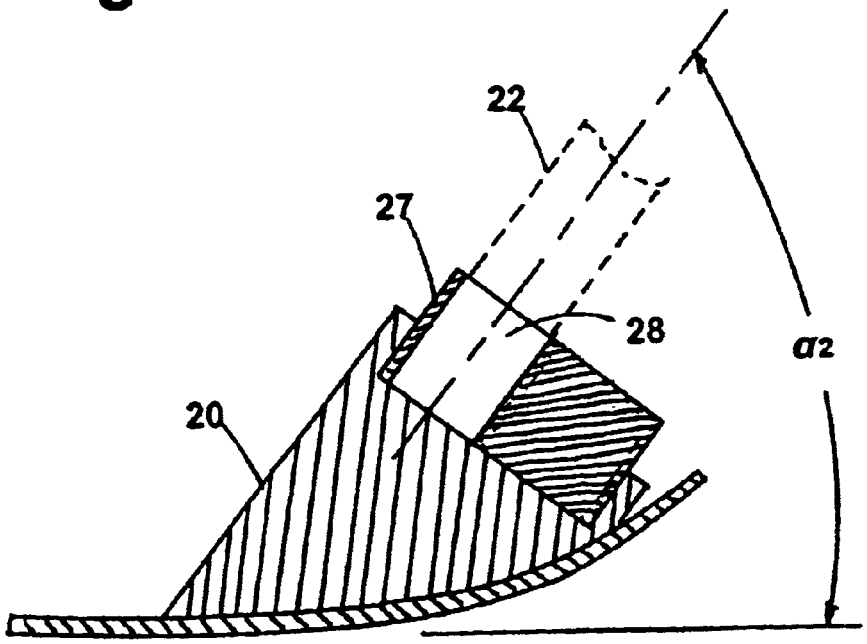

The present invention selectively positions the shaft for a particular club lie as disclosed in FIGS. 6*a* and 6*b*. This embodiment of the invention does not position the boss member in various locations within the lower hosel element 20 to obtain a variety of club lie positions. Rather, this embodiment utilizes a plurality of boss members 27, each with a particular shaft opening location 28, to effect a particular lie position. Thus all castings may be made with a universal lower hosel element that is positioned on the sole to accommodate a particular club face angle with the lie angle created by the particular boss member selected. The lower hosel element may be cast as part of the sole or may be welded in place. The boss member is preferably friction fitted and then secured by welding.

Front section 11 includes an impact face 23, upper lateral extension 24, lower lateral extension 25, and a wing element 29 extending outwardly into the skirt portion 18 below and beyond the upper hosel element 19. Wing element 29 has a length y that is preferably greater than about 20 mm. Impact face 23 is preferably made of stamped titanium plate, more preferably beta-titanium and is of variable thickness. The wing element 29 preferably extends beyond the width of upper hosel element 19, which is part of cast body 12.

Figure 7B:
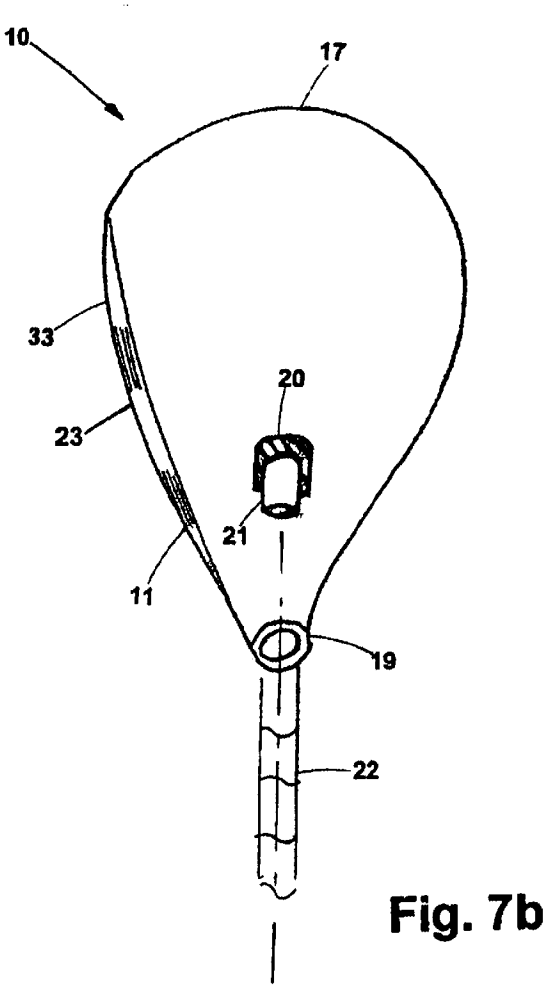
FIG. 7*b* is a top view with the boss member positioned a distance back from the face to provide a more closed-face angle relative to FIG. 7*a*.
Figure 7A:
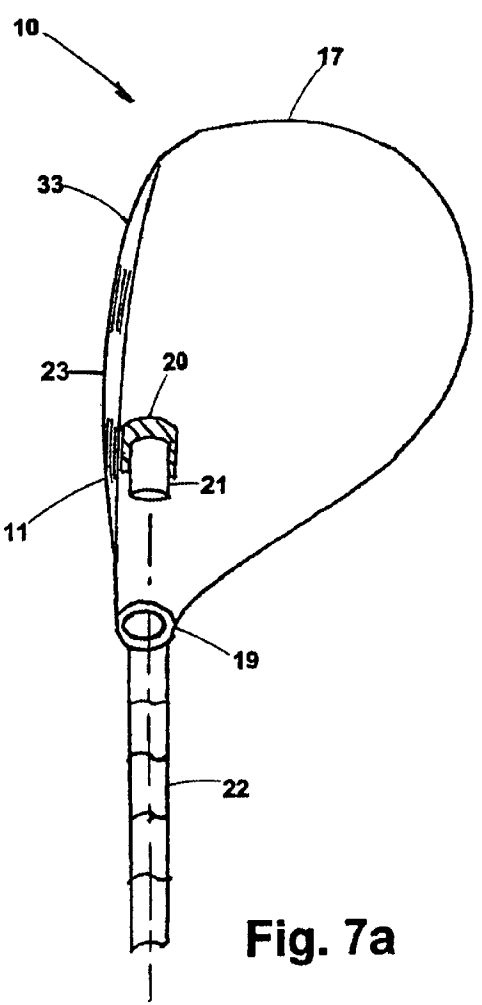
FIG. 7*a* is a top view with the boss member positioned close to the front face to provide a relatively open-face angle.

The lower hosel element 20 may be selectively placed in a position relative to the impact face 23, wherein the face angle of the club can be adjusted between that of an open-faced versus that of a closed-face. Placing lower hosel element 20 nearer to the impact face 23, as shown in FIG. 7*a*, will create a relatively open-faced club, while placing it further rearward from the impact face 23, as shown in FIG. 7*b*, will produce a club having progressively more closed-face club angles as shown by FIG. 7*a*. The positions of the lower hosel element, as shown in FIGS. 7*a* and 7*b*, are exaggerated for illustration purposes and are not to scale. Typical club face angles for metal wood club heads will usually be in a range of about 0.5° Open to about 3.0° Closed. The stronger players will usually prefer a club face anale that is square to slightly open, and the higher handicap players more often prefer the club face angle slightly closed.

The present invention, by incorporating the aforementioned wing element 29 into body 12, enables weight that is normally used in the hosel area, to be placed elsewhere in the club head 10 for optimum ball flight.

The design of the cast body 12 (having the toe portion 14 including a front face section 33) and front section 11 is such that welding is kept a relative distance away from the toe portion 17. This increases the stability of the cast body during manufacture and insures minimum deformation of the aesthetically critical toe portion 17 during welding or polishing.

The upper lateral extension 24 extends into and engages the crown portion 14 at a first predetermined distance. In a preferred embodiment, the first predetermined distance ranges from 0.15 inch to 1.10 inches, and more preferably from about 0.20 to 0.32 inch, as measured from the crown/face transition seam 30 to the edge of the upper lateral extension 24. This engagement is generally through welding or the like along an engagement line 34. The lower lateral extension 25 engages the sole portion 14 at a second predetermined distance (measured from the sole/face transition seam 31 to the edge of the lower lateral extension 25).

In a preferred embodiment, the predetermined distance ranges from 0.15 inch to 1.10 inches and more preferably from about 0.20 to 0.32 inch. The welding engagement along line 34 shifts the weld zone rearward from the critical transition seams 30 and 31, therein reducing the thickness at the seams; a vital parameter in maximizing COR value. Beta-titanium and Alpha-titanium materials are preferred in the face section because of superior mechanical properties, such as strength and ductility.

Figure 8:
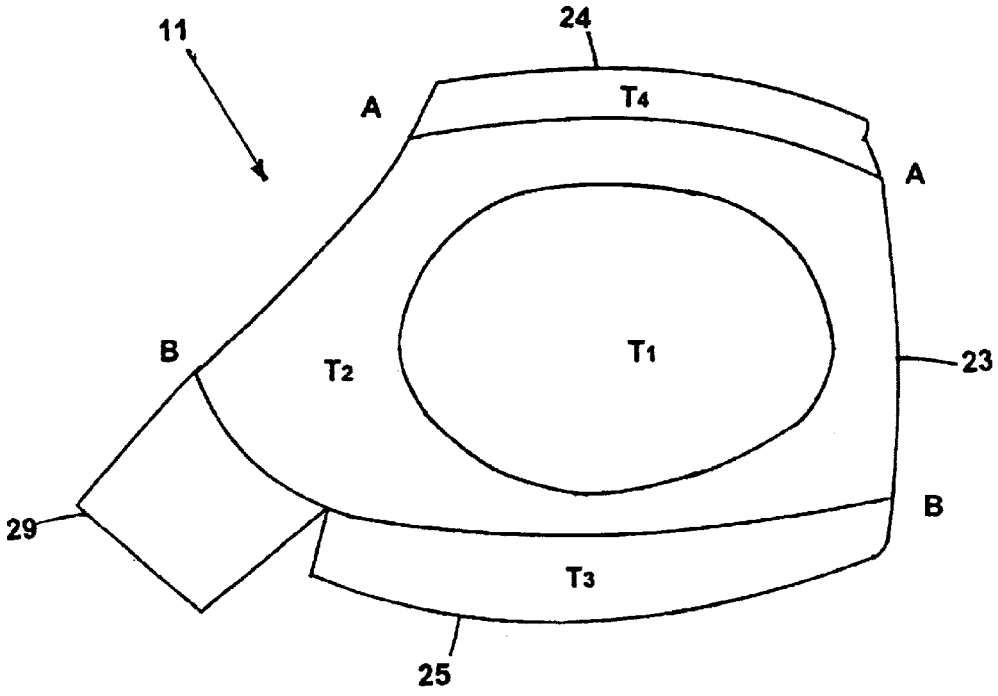
FIG. 8 is a single sheet metal plate which comprises the front section prior to being formed into a cup shape.

As described above, front section 11 may be formed into a generally cup shape from a single stamped metal sheet plate, as shown in FIG. 8. The front section 11 is not forged but preferably formed from stamped sheet metal and may be of varied thickness or may be of uniform thickness. The upper lateral extension 24 having a thickness T4 between about 0.025 to about 0.059 inch and formed by bending in the area of A—A. Both, the lower lateral extension 25 as well as the wing element 29, are formed by bending along line B—B. The thickness T3 of sole lip 25 and wing element 29 is between about 0.035 to about 0.079 inch. The impact face 23 is preferably of varying thickness but may be of uniform thickness as well. When having a varied thickness impact face 23 has a central portion $T_1$ having a thickness of between about 0.090 inch to about 0.130 inch and an exterior perimeter area $T_2$ of between about 0.050 to about 0.105 inch. The impact face 23 is only partially formed by the front section 11 and is completed by the front face section 33 of the toe portion 17.

While various descriptions of the present invention are described above, it should be understood that the various features of each embodiment can be used singly or in any combination thereof. Therefore, this invention is not to be limited to only the specifically preferred embodiments depicted herein. Further, it should be understood that variations and modifications within the spirit and scope of the invention may occur to those skilled in the art to which the invention pertains. Accordingly, all expedient modifications readily attainable by one versed in the art from the disclosure set forth herein that are within the scope and spirit of the present invention are to be included as further embodiments of the present invention. The scope of the present invention is accordingly defined as set forth in the appended claims.

What is claimed is:

1. A metal wood golf club head adapted for attachment to a shaft comprising:

a substantially hollow body coupled to a front section to define a cavity therein:

the body comprising a crown portion, a sole portion, a toe portion, a heel portion, a skirt portion connecting the heel portion to the toe portion, an upper hosel element, and an opening for accepting the front section;

a lower hosel element extending from an inner surface of the sole portion;

a boss member selected from a plurality of boss members, each of the plurality of boss members positionable on an upper surface of the lower hosel element, wherein each boss member has an inherently different location for a shaft opening of a size and configuration therein for accepting the lower end of the shaft, the location of the shaft opening within each boss member corresponding to a predetermined club lie.

2. The club head according to claim 1, wherein the lower hosel element extends less than about 0.25 inch from the sole plate.

3. The club head according to claim 1, wherein the lower hosel element is coupled to the sole portion at a distance relative to the impact face, wherein when the lower hosel element containing the boss member is located at a distance relatively near to the front face an open-faced club angle is created, while when the lower hosel element containing the boss member is located at a distance further away from the front face a more closed-face club angle is created.

* * * * *